US005555817A

United States Patent [19]

Taillon et al.

[11] Patent Number: 5,555,817

[45] Date of Patent: Sep. 17, 1996

[54] PAD OF SUBSTANTIALLY RIGID SYNTHETIC RESIN FOR A FRICTION WEDGE IN A BOLSTER POCKET

[75] Inventors: Armand P. Taillon, Chicago, Ill.; Philip J. Brunkhorst, Sioux City, Iowa

[73] Assignee: Standard Car Truck Company, Park Ridge, Ill.

[21] Appl. No.: 269,554

[22] Filed: Jul. 1, 1994

[51] Int. Cl.[6] ..... B61F 3/00

[52] U.S. Cl. ..... 105/198.2

[58] Field of Search ..... 105/198.4, 198.2; 267/3, 134, 137, 196; 188/381

[56] References Cited

U.S. PATENT DOCUMENTS

| | | | |
|---|---|---|---|
| 2,053,990 | 9/1936 | Goodwin | 105/193 |
| 2,333,921 | 11/1943 | Flesch | 105/197 |
| 3,559,589 | 2/1971 | Williams | 105/197 |
| 4,174,140 | 11/1979 | Bogar | 308/137 |
| 4,230,047 | 10/1980 | Wiebe | 105/197 |
| 4,295,429 | 10/1981 | Wiebe | 105/197 |
| 4,344,365 | 8/1982 | Fritz | 105/282.2 |
| 4,426,934 | 1/1984 | Geyer | 105/197 DB |
| 4,875,813 | 10/1989 | Moyer | 410/9 |
| 4,915,031 | 4/1990 | Wiebe | 105/198.2 |
| 4,974,521 | 12/1990 | Eungard | 105/198.4 |
| 5,176,083 | 1/1993 | Bullock | 105/198.2 |

OTHER PUBLICATIONS

Compressive and Shear Load/Deflection Testing of Two Designs of Plastic Pad Equipped Railroad Freight Car Truck Friction Castings–Engineering Systems Inc. Report.

*Primary Examiner*—Robert J. Oberleitner
*Assistant Examiner*—C. T. Bartz
*Attorney, Agent, or Firm*—Alfred D. Lobo

[57] ABSTRACT

A novel friction wedge for use in a bolster pocket of a truck of a railroad car, comprises a metal body portion having a vertical wall and one or more pad members supported on the surface of a pad-support body. The metal body portion has a vertical wall the exterior surface of which body bears against a guide column of the side frame. The pad-support body, which is part of the metal body portion, is provided with an inclined surface upon which is secured a polymer pad with a central planar inclined surface which bears against the correspondingly inclined surface of the pocket. The pad member is required to be formed from specified reaction injection molded (RIM) polymers which it is found to be free of microscopic voids >20 μm and therefore, fully dense, unlike prior art polymer pads for friction wedges. This property of being fully dense unexpectedly allows the pad to have specified physical properties which permit a railroad car truck equipped with the friction wedges to operate with exceptional reliability, safety and for a long period of time. In a particular embodiment, the design of the pad(s) permits relative movement of the pad and the metal body of the friction wedge to locate the center of pressure accurately on the friction wedge, under load, and this further improves the effectiveness of the friction wedge and extends its useful life.

20 Claims, 9 Drawing Sheets

PAD OF SUBSTANTIALLY RIGID SYNTHETIC RESIN FOR A FRICTION WEDGE IN A BOLSTER POCKET

BACKGROUND OF THE INVENTION

Friction wedges, so referred to because of their general shape, but also referred to as friction castings, are used in a wedge-shaped bolster pocket ("pocket" for brevity) of a railroad car truck ("truck" hereafter) to damp oscillations of springs supporting the truck's bolster (bolster). Such friction castings are conventionally made of cast iron, cast as a unitary article, or, are made by combining a cast iron body with a wear plate or "pad" of chosen material. Use of a wear plate is taught in U.S. Pat. Nos. 3,559,589 to Williams and to 4,426,934 Geyer; use of twin pads of polymer, aptly positioned in the pocket is taught in U.S. Pat. No. 4,974,521 to Eungard, the disclosure of which is incorporated by reference thereto as if fully set forth herein; and, each of the foregoing, inter alia, illustrates the stabilizing function of a friction wedge.

A unitary friction wedge is typically cast as a single metal body, preferably of acicular cast iron or cast steel, and, as it is held in the pocket, presents a slanted planar face, slanted at an angle in the range from 50° to 60° to the horizontal, a vertical face (plane forming the y-axis), and a horizontal bottom face (x-axis plane). In a combination friction wedge, a pad means, namely, one or more pad members, is secured on the slanted supporting surface of a metal body support member of a wedge-shaped cast iron body, and the combination friction wedge is positioned in the pocket such that the pad's exposed surface abuts the slanted surface of the pocket; and, the vertical face of the cast iron body is biased against a guide column of the truck's side frame (hence referred to herein as a 'friction casting'). In the present invention, the pad means is a synthetic resin or polymer, having specified properties which provide the friction wedge with safe, reliable and long-lived service under operating conditions.

The problem is to exert the appropriate amount of friction force in reaction to, and as a function of, the forces exerted by the truck while the car is in motion, such that the "ride" of the car is controlled within predetermined limits. This problem is satisfactorily solved with a conventional acicular unitary cast iron friction casting, except that the slanted cast iron surface of the friction casting causes an excessive amount of wear on the inclined bottom wall of the bolster which is also the inner surface of the rear wall (provided by the end of the bolster) of the pocket due to the abrasive effect of the harder (than hard steel) cast iron, on the hard steel of the bolster. However, deformation under load and thermal stability were not problems when a unitary cast iron friction casting was used. Therefore, to use a polymeric material successfully, the problem was narrowed to finding a substitute material not only with better non-abrasive properties, or, stated differently, better lubricity, but with acceptably minimal compressive deformation even at the elevated temperature conditions to which a truck is subjected during operation.

Still further, the material chosen was to have characteristics which lent it to being shaped precisely, with conventionally available techniques, economically, and which allowed the shaped material to maintain its shape during operation, over time.

Thus, the present invention specifically seeks to emulate the satisfactory performance of the unitary cast iron friction wedge against the hard steel of the bolster, by substituting a combination friction wedge in which the slanted surface is provided by a specific type of known synthetic resinous materials (polymers). Such a polymer has better lubricity (lower coefficient of sliding friction) than a material suggested for such use in the prior art, does not deform appreciably even at elevated temperature, and has great tensile strength and resistance to impact.

Half a century or more ago, friction wedges with a resilient pad member were known to be desirable, as disclosed in U.S. Pat. Nos. 2,053,990 to Goodwin; 2,333,921 to Flesch; 2,693,152 to Bachman; and, more recently in U.S. Pat. Nos. RE. 31,784; 4,295,429 and 4,915,031, to Wiebe, inter alia. Despite the deficiencies of the resilient pad members disclosed in the prior art, Wiebe in the '031 patent, requires that a pad of his friction casting be formed from an elastomer which provides a particular "stick-slip" action (see col 2, lines 18–19) distinct from the abrupt action believed to be provided by other friction castings such as cast iron unitary wedges.

In particular, Wiebe taught that the elastomeric friction elements disclosed in the '784 and '429 patents offer improved damping for all modes of relative bolster to side frame motion, and that preferably, such elastomer means be combined with a friction casting having a metal body. Further, that overstraining portions of an elastomeric element causes those portions to take a permanent set and/or lose some of their resiliency or fail structurally; and that when the resiliency of an elastomeric element loses uniformity, its ability to operate as described in the identified patents may be substantially impaired (see col 3, lines 9 et seq).

From the foregoing it is clear that the teaching of an elastomeric element requires that it not only be an elastomer, but that the elastomer have desirable resiliency such that overstraining and overheating of the elastomer will not cause its deterioration. Flesch '921 teaches that the resilient pads he uses are compressed between friction shoes and wedge members whereby the compression of the resilient pads remains substantially unchanged upon relative vertical (y-axis) movement of the bolster and side frames. While he states "any suitable resilient material" (col 3, lines 32–33) may be used, he requires that "any longitudinal movement of the bolster with respect to the side frame will be cushioned by further compression of the rubber pads." (see col 4, lines 14–17). Clearly the pads are compressible.

Though the references all refer to a resilient material having the desirable characteristics to meet the demands of an operable friction wedge, they make it abundantly clear that choosing the "right" material to meet the exigent performance specifications of a friction wedge, is a difficult task which does not lend itself to routine trial and error experimentation such as one skilled in the art would be expected to undertake. The material must not only have the friction characteristics desired, but those properties must be available over the operating range of temperature and pressure exerted by a railroad car in operation. Further, a synthetic resinous material chosen must not abrade excessively, nor cause excessive wear in the pocket, nor deteriorate over the expected service life of the railroad car, all problems which, in most materials, is exacerbated by thermal and oxidative degradation due to the material being heated under conditions normally encountered in operation of the car.

At the present time, friction wedges are commercially available in which the pad member is formed from the following materials: ultrahigh molecular weight (UHMW)

polyethylene (PE) disclosed in the '521 patent; cast polyurethane having microscopic voids >10 μm (micrometers), usually >20 μm, characteristic of cast crosslinked polymers; and, cast molybdenum-filled polyurethane (UMF) having a Shore D hardness of less than 70 (<70 Shore D). Each of the prior art materials suffers from unacceptable thermal degradation under load, and, a sliding coefficient of friction which is in the range above 0.2, typically about 0.3, as measured in a test in which moduli values are calculated to represent effective values for the "in situ" or installed pad configurations as developed in a test used by Engineering Systems Inc. and designed for the purpose by Robert W. Bullock. (see ESI File No. 1651 A).

It should be noted that a pad placed on the slanted face of a friction casting provides an insulator in one of the primary paths for conduction to dissipate heat generated. As a result, the temperature of the pad can remain in the range from about 93°–149° C. (200°–300° F.) for extended periods of time during operation of a car on hot Summer days.

Specifically, prior art polymer pads suffer >5% compressive deformation (or, are strained more than 5%) at 177° C. (350° F.) under pressure of 6890 kPa (1000 psi), and >1% compressive deformation under pressure of 6890 kPa (1000 psi) and a temperature of 38.8° C. (100° F.) and poor tensile strength. As a result, pad members made from the prior art materials are found to require premature replacement at the end of only one year, when the pad members are used in 90.7 metric ton (100-ton Avdp US) flat cars carrying heavy machinery from a manufacturing plant to a shipping site, in dedicated service. In contrast, a reaction injection molded (RIM) polymer which is essentially non-deformable as defined herein, and particularly such a RIM polymer having a minor amount by weight of a polyolefin disperse phase, provide pads which have an unexpectedly advantageous combination of lubricity and lack of compressive deformation; and, are surprisingly long-lived in 100-ton flat-cars used under substantially the same conditions as those used to test the prior art friction wedges.

It is further believed that the absence in the RIM pads, of microscopic voids 20 μ in nominal diameter, such as are generally present in a cast polymer matrix, unexpectedly provides the pads not only with (i) great tensile strength surprisingly greater than that of cast polymer, and (ii) essentially no compressive deformation, but also with (iii) hysterisis characteristics which approach the energy loss of acicular cast iron.

In the invention described in greater detail herebelow, it is essential that the polymer chosen for use as a pad, be non-elastomeric, essentially incompressible under normal loads, even at a temperature as high as 177° C., or a railroad car will neither provide satisfactory operation, nor safe and reliable service over its expected service life. As will presently be evident, it is essential that a substantially rigid polymeric pad be used, and that the pad, as a component of a friction wedge be essentially non-deformable under the conditions of its use.

By "substantially rigid" is meant that the polymeric pad used herein, when subjected to a distortion force normally encountered within the environment of a bolster pocket at ambient temperature, and associated with the securing operation of an assembly of springs between the bolster and the side frame, is capable of resisting the distortion force applied to the pad as it is oriented in the pocket, and capable of maintaining the wedge's formational shape thereafter.

The term "elastomer" is used herein in its accepted meaning to refer to a polymeric material such as a synthetic rubber or plastic, which at room temperature can be stretched under low stress to at least twice its original length and upon immediate release of the stress returns with force to its approximate original length (McGraw Hill Dictionary of Scientific and Technical Terms, pg 648, 5th Edition, McGraw Hill Book Co.) The phrase "sufficiently crosslinked to provide a substantially rigid matrix" is used to refer to a RIM polymer which has the physical properties described below.

By "essentially non-deformable" and "essentially no compressive deformation" is meant that the material has a compressive deformation of less than 1% at 38° C (100° F.), and more importantly, <5% at 177° C. (350° F) under a load which produces about 6890 kPa (1000 psi) pressure, indicating the material is essentially incompressible in the stated temperature range under the operating conditions for a truck.

Though the wedge-shaped pocket is conventionally used in railroad cars in this country, the invention herein may be adapted for use in a bolster pocket of arbitrary shape, so long as the inner surface of the rear wall of the pocket has a proclivity to wear undesirably due to the continuous vibrations to which the bolster is subjected while a car is in operation. More specifically, friction wedges of this invention are shaped as described in the aforementioned '031 or '521 patents. Such shapes include a unitary generally rectangular pad between the slanted surface on the body of a friction casting and the inner surface of the rear wall of the pocket, and, a pair of generally rectangular pads, or pads molded with an arcuate rear surface to fit on a support portion of a friction casting, are used. Twin pads may be self-adjusting during use, so they make full contact with the pocket's slanted rear wall and adjoining side walls.

SUMMARY OF THE INVENTION

It has been discovered that a friction wedge comprising a cast iron body and one or more pads of a polymer, not an elastomer, provides safe and long-lived service, provided the pad is formed from particular polymers which are reaction injection molded (RIM) to be "fully dense", and further providing that the fully dense polymer matrix formed has essentially no compressive deformation. By "fully dense" is meant that there is no statistically significant number of microscopic voids larger than 20 μm, and preferably not larger than 10 m, present in the matrix.

To meet the requirements for economically producing a dimensionally accurate pad member of a friction wedge which operates satisfactorily, that is, with desirable lubricity and friction characteristics, thermal and oxidative stability, and toughness, it is critical that the pad member be stable to thermal and oxidative degradation at about 177° C. (350° F.), the upper limit of temperature encountered during operation of the friction wedge in the truck of a railroad car.

By "stable to thermal and oxidative degradation" is meant that it is critical that the pad member be essentially non-deformable at a temperature as high as 177° C.; and that its reduction in energy loss, as calculated from a hysterisis curve, be no greater than 25%, the basis for comparison being acicular cast iron. Such stability is most preferably provided by a pad member of a specified RIM polymer matrix infused, during formation of the matrix, with a minor amount by weight of a polyolefin.

The polyolefin is present as a disperse phase in the specified RIM multi-phase polymer matrix wherein hard segments of chains of reacted polymer in the matrix provide the continuous phase. The polyolefin particles are believed to stop crack propagation in the matrix, and to function not only as an impact modifier, improving modulus, toughness and wear resistance, but also helps to minimize microscopic voids so as to produce a fully dense, essentially non-deformable (at 38° C.) matrix having a durometer hardness in the range from 70–90 Shore D and desirable lubricity. Yet, a PE-containing RIM polymer matrix has improved abrasion resistance, particularly to sliding abrasion, by lowering the coefficient of sliding friction for the polymer matrix.

By including as little as 10% by weight of PE particles in the matrix, one can maintain the lubricity of the PE by itself, while it is in a matrix which, by itself, normally has a much higher coefficient of friction.

It is particularly unexpected that despite the relative softness (63–65 Shore D) of PE particles dispersed in the polymer matrix, and the known proclivity of dispersed PE particles to reduce the density of the matrix, the rigidity of the polymer matrix is maintained and its abrasion resistance is excellent.

A polymer pad member of the novel friction wedge not only produces the stated small reduction in energy loss but exhibits minimal wear on the inner surface of the rear wall of a bolster pocket. The rear wall of each pocket in a bolster is provided near the end thereof by equally angled but oppositely directed inclined surfaces, on either side of the bolster. Each surface is typically angulated at about 55° to the x-axis. Since there is only one surface in a pocket so inclined, that surface of the inner wall of the pocket is referred to herein as the "pocket's inclined surface".

It is therefore a general object of this invention to provide a friction wedge comprising, a metal body and at least one pad member consisting essentially of a, substantially reaction injection molded polymer matrix component essentially free, of microscopic voids >10 μm in diameter, and more preferably >5 μm, which matrix is fully dense, substantially rigid as evidenced by a shear modulus >515000 kPa (75,000 psi) and essentially non-deformable as evidenced by a compressive deformation of <5% at 177° C.

It is a specific object of this invention to provide a friction wedge having a pad member of a non-deformable RIM polymer matrix having dispersed therein a minor proportion by weight of a polyolefin present as a disperse phase, the polyolefin being selected from the group consisting of polyethylene (PE) and polypropylene (PP).

It is another specific object of this invention to provide a friction wedge having a metal body of a generally wedge shape (in side elevation), one vertical wall, one support body with a slanted surface, and a horizontal base member, the metal body being used in combination with a pad means of a RIM polymer. The term "pad. means" refers to at least one pad member, and, depending upon the design and construction of the metal body, plural pad members. Typically one or two pad members are used on each support body of a friction casting.

The RIM polymer has a tensile strength of at least 27500 kPa (4000 psi), preferably from 34500 to 55000 kPa (5000–8000 psi) measured at 25° C., and the pad means is adapted to be slidably inserted in a bolster pocket of a railway truck assembly so that a vertical surface friction wedge's of the support metal body is biased against a guide column of the truck's side frame. The support body has the pad member(s) secured on the slanted surface of the support body so that, in operation, the pad member(s) is biased against the pocket's inclined surface.

The pad member(s) presents an exposed surface correspondingly slanted (with that of the pocket's inclined surface) so that the pad's exposed surface coextensively abuts the rear wall provided by the terminal portion of the bolster.

The RIM polymer matrix component is selected from the group consisting of an essentially non-deformable, substantially thermoplastic copolymer, and an essentially non-deformable, substantially cross-linked polymer which is not thermoplastic. Preferred are (i) a triblock copolymer of a polyol prepolymer and a ring-openable lactam, referred to herein by the code XP-91; (ii) a substantially crosslinked polyurea or polyurethane; (iii) a substantially crosslinked polymer of one (homopolymer) or more (copolymer) cyclodiolefins; and (iv) nylon, each of which is RIM. Most preferred is one of the foregoing RIM polymers containing from 1 to about 20% by weight, preferably about 5 to 15% by weight, of surface-modified PE dispersed throughout the polymer matrix.

It is a specific object of this invention to provide a pad member formed from a polymer matrix having dispersed therein from about 1–10 percent by weight of surface-modified PE, based on the weight of the polymeric pad member, in a matrix which has a durometer hardness of at least 70 Shore D, preferably more than 75; a modulus of elasticity in tension (tension modulus) of at least 1.03 MPa (150,000 psi); a modulus of elasticity in shear (shear modulus) of at least 689,000 kPa (100,000 psi); all measured at room temperature 25.5° C. (78° F.); and lower compression deformation than any of the following: (a) ultrahigh molecular weight (UHMW) polyethylene (PE); (b) cast polyurethane having <70 Shore D hardness; (c) cast molybdenum-filled polyurethane (UMF) having <70 Shore D. The compressive deformation of the pad member molded as a multi-phase polymer matrix, is required to be <1% at 38° C. (100° F.), <5% at 177° C. (350° F.), and more preferably, <0.5% at 38° C., and <2.5% at 177° C. The foregoing properties are obtained in the best mode of the invention wherein the pad members are formed from a commercially available Nyrim® polymer infused with <10 parts by weight of surface-modified PE which provides a coefficient of sliding friction in the range from 0.1 but not more than 0.2, measured with an external load in the range from 4–20 kips between clean steel surfaces at ambient temperature (25.5° C.).

It is another specific object of this invention to provide a friction wedge with a single pad member, preferably removably secured to the slanted surface of a support body of the metal body component of the wedge.

It is still another specific object of this invention to provide a friction wedge with twin pad members, preferably removably secured to the slanted surface of the support body of the metal body, which pad members are in mirror-image relationship with one another.

BRIEF DESCRIPTION OF THE DRAWING

The foregoing and additional objects and advantages of the invention will best be understood by reference to the following detailed description, accompanied with schematic illustrations of preferred embodiments of the invention, in which illustrations like reference numerals refer to like elements, and in which.

DETAILED DESCRIPTION OF PREFERRED EMBODIMENTS

Figure 2:
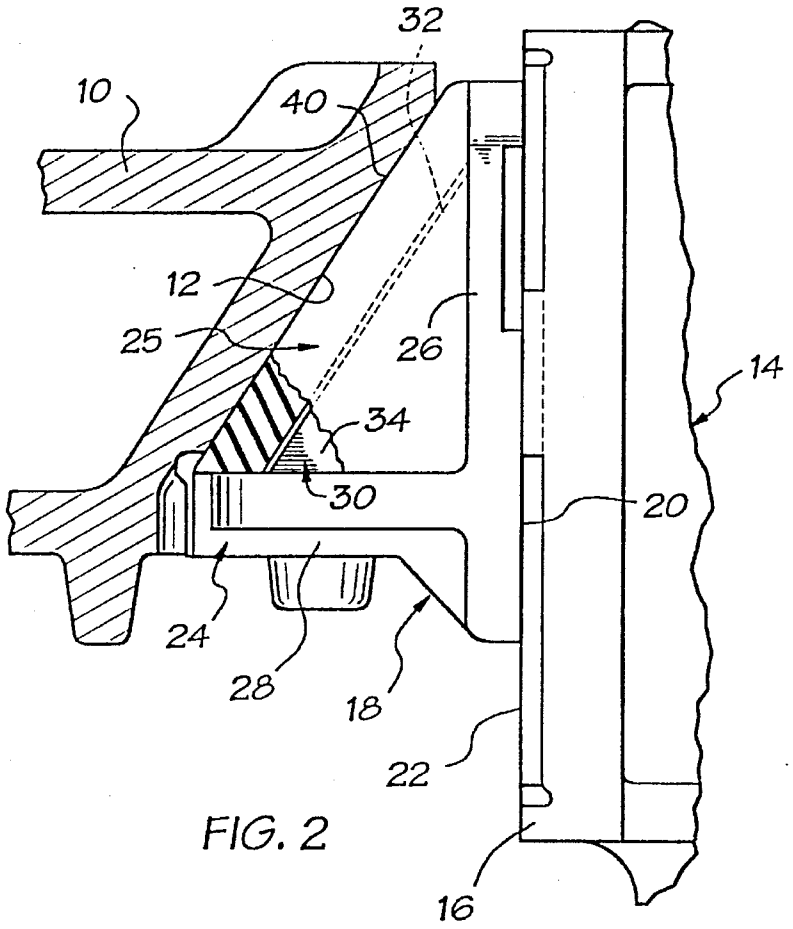
FIG. 2 is a side elevational section taken substantially along plane 2—2 of FIG. 1, showing a first embodiment of the friction wedge comprising a combination of a generally wedge-shaped metal body and two pad members.

Wear on the bolster pocket side walls, particularly the outboard side wall, is especially serious in high mileage, high utilization railroad cars, such as those on unit coal trains, and trains in dedicated service hauling heavy loads to a designated site. Over a period of many months, usually years, the relative movement of bolster and side frame causes wear which is due to a combination of "hunting," the rock and roll action of a freight car on rough track, and the action of the truck passing through a switch wherein the bolster may move laterally relative to the side frames. Whatever the cause of wear, wear in the bolster pocket is unexpectedly small when a friction wedge described herein is used.

The novel friction wedge is required to have a pad member made in a conventional RIM process using a die having matched upper and lower mold members gated at a parting line. The interior mold surfaces of the upper and lower mold members define a mold cavity having the desired dimensions of the pad member. After the upper mold member is closed upon and locked to the lower mold member with a clamping force in the range from 10–50 tons, the components of the polymer matrix to be formed are injected into the mold cavity. The components are typically stored as free-flowing liquids having a viscosity in the range from 0.1–1 Pa. sec,, in tanks at a temperature in the range from 150°–200° F. and the mold is maintained at a temperature of about 60°–150° C., preferably about 121° C. (250° F.). A pad member may be demolded soon after the matrix is cured in the mold, usually within less than 10 minutes, preferably within 3–5 min. The RIM process is practiced in a conventional RIM machine or a Resin Transfer Molding (RTM) machine, at an autogenous molding pressure in the range from 350–700 kPa (50–100 psi) developed during the curing of the resin due to the exotherm.

In an illustrative example in which all parts refer to parts by weight, a two-part mixture is injected into the mold. One part, Part A, is a mixture of 21 parts polyether polyol prepolymer such as poly(tetramethylene oxide) diol, 25 parts caprolactam, 4 parts surface-modified polyethylene, and 0.5 parts of an antioxidant. The other part, Part B, is a mixture of 39 parts caprolactam and 11 parts $MgBr_2$ catalyst. When the components are mixed, the catalyst generates 6-nylon or nylon-6 by ring-opening and homopolymerizing the caprolactam until the growing chain encounters a polyol chain. When this happens the terminal —OH group of the glycol, specifically an alpha, omegadiol, is connected with the growing amine chain end of the nylon-6 through an ester linkage. The same ester linkage is generated at the other, still unreacted end of the glycol, thus linking another nylon-6 chain. In a mass of the resulting polymer, a phase separation occurs in which the prepolymer molecules provide the disperse phase, along with the polyethylene which, of course, does not take part in the chemical reaction but functions as a filler which modifies the lubricity of the polymer matrix formed. The cured polymer matrix of the pad member has a Shore D in the range from 75–80. The hardness may be increased by increasing the ratio of caprolactam to polyol since the caprolactam forms a poly(caprolactone) soft segment and the polyol forms a hard segment in a chain of the polymer formed.

In an analogous manner, a polyurethane or polyurea RIM polymer matrix may be formed with soft segments generated with monomers analogous to those used for the soft segment of the triblock. For example, soft segments may be chosen from prepolymers of polyester and polyether diols, based on polyoxypropylene polyols, polycaprolactone, polytetramethylene oxide glycols, polybutylene oxide glycol, and poly(dimethylsiloxane) diol, in turn derived from propylene oxide, ethylene oxide, tetrahydrofuran, dimethylsiloxane, and the like. The hard segments of a polyurethane may be chosen from p,p'-diphenylmethane diisocyanate (MDI), toluene diisocyanate (TDI), hexamethylene diisocyanate (HMDI) and the like. As in the triblock, each of the RIM polymers formed may include less than 10 parts, and preferably about 5 parts by weight of surface-modified polyethylene such as Primax® UH-1000 Series UHMW PE particles sold by Air Products and Chemicals, Inc.

In an illustrative example, a RIM polyurethane formulation is approximately as follows: 15% NCO; 100 parts prepolymer; 20 parts Primax® PE particles and 18.7 parts methylene orthochloroaniline (MOCA) with a stoichiometry of 95%.

To control the thermal expansion of the pad member it may be desirable, to "fill" the polymer matrix with a mineral filler such as mica or glass which may be in the form of milled fibers, flakes or chopped glass strands. The amount used may be in the range from 5–20% by weight of the polymer matrix formed, depending upon how much the expansion of a heated pad is to be minimized.

The test method used for measuring the compressive deformation of a polymer matrix is set forth in ASTM test D 621–64 titled Standard Test Method for Deformation of Plastics Under Load (re-approved 1988). It is a sensitive method which gives a measure of the ability of a rigid plastic in and assembly, to withstand compression without yielding and loosening the assembly over a period of time. The method also provides thermomechanical characteristics by measuring the elastic and loss moduli as a function of, frequency, time, or temperature, the last named being used herein because thermal degradation is the chief concern over the long period of time, usually ten (10) years, over which a railroad car operates without having the friction wedges replaced.

The test method used for measuring the tensile properties of a polymer matrix is set forth in ASTM test D 638–89 type I titled Standard Test Method for Tensile Properties of Plastics. The test was conducted at room temperature (25° C.) with specimens having a nominal thickness of 0.635 cm (0.250"), measuring from 0.15% in/in strain to 0.20% in/in strain.

The sliding coefficient of friction of UHMW PE, by itself is in the range from 0.12 to 0.17; the sliding coeffficient of friction of Shore 70 D polyurethane by itself is in the range from 0.25 to 0.32; the sliding coeffficent of friction of Shore 70 D polyurethane infused with 2.5% by wt of molybdenum sulfide is in the range from 0.22 to 0.28; the siding coefficient of friction of the triblock. Nyrim by itself is in the range from 0.2 to 0.32; but, the sliding coeffficent of friction of Nyrim with the PE, less than 5% by wt, is in the range from 0.12 to 0.17.

Figure 1:
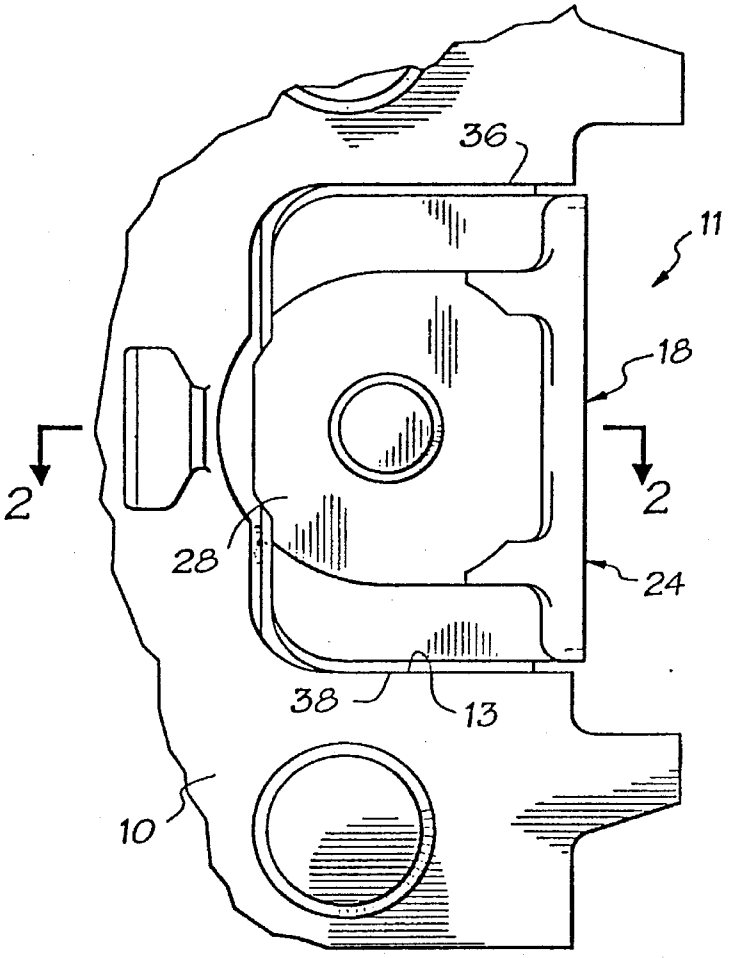
FIG. 1 is a bottom plan view of a friction wedge inserted in the pocket of a bolster of a railroad car, only a portion near one end of the bolster being shown.

Referring to FIGS. 1 and 2, there is illustrated a bolster 10 and, near one terminal end thereof, having the bolster pocket 11 which has a slanted rear wall 12 and side walls 13. Facing bolster 10 is a side frame, indicated generally at 14, having a guide column 16 of the side frame, which guide column and the bolster's end, form the bolster pocket in which a friction wedge, indicated generally at W1 is continued.

Friction casting 18 comprises a wedge-shaped metal body 24 formed of acicular cast iron, having a generally vertical wall 26 which presents a wear surface 20 pressed against a side frame wear plate 22 and a horizontal base 28 the lower surface of which provides a spring seat 29 for a helical coil spring (not shown) which is received in a teat to hold the spring in a vertical position. Connecting the vertical wall 26 and the base 28 is a support member, cast as a portion of the friction casting 18, which support may have different configurations, described below, to present an appropriate support surface for the pad or pad members to be used. The support surface has a planar area at least large enough coextensively to support a central portion of the pad means to be used. It is not essential that the pad means be provided with sides to contact and bear against the side walls of the bolster pocket, though it is generally found advantages to have them do so. In the side elevational view (FIG. 2), the central planar support surface is seen as inclined surface 32, the hypotenuse of a right angle triangle formed by the vertical wall 26 and the horizontal base 28.

Figure 4:
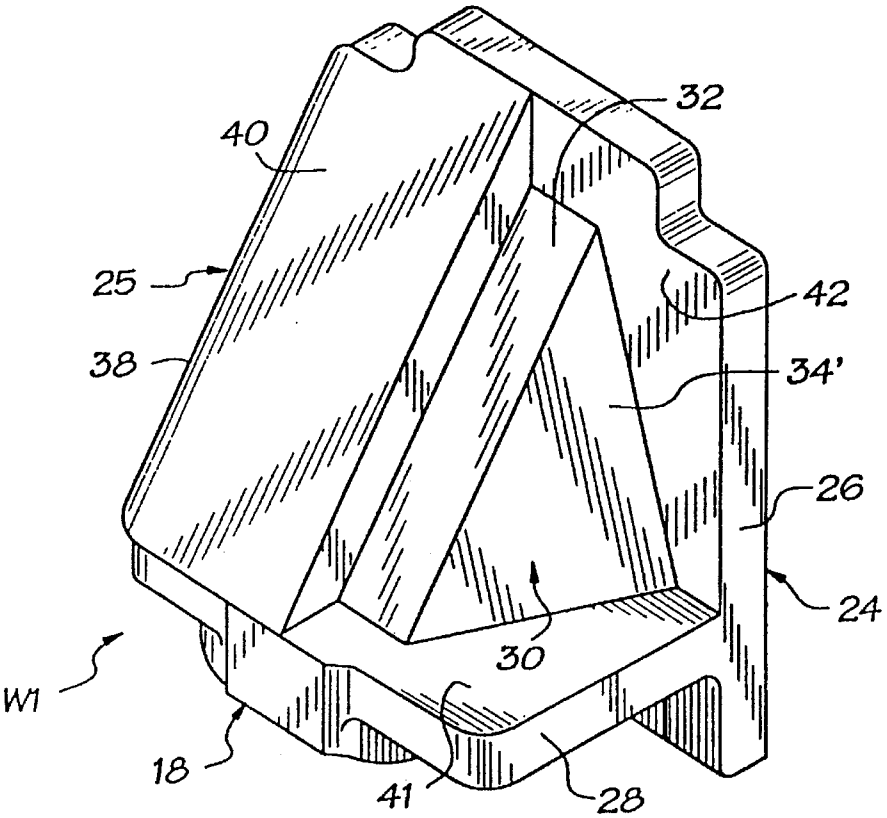
FIG. 4 is an isometric view of the friction wedge and one of the two pad members held between the vertical wall and horizontal base of the metal body.
Figure 3:
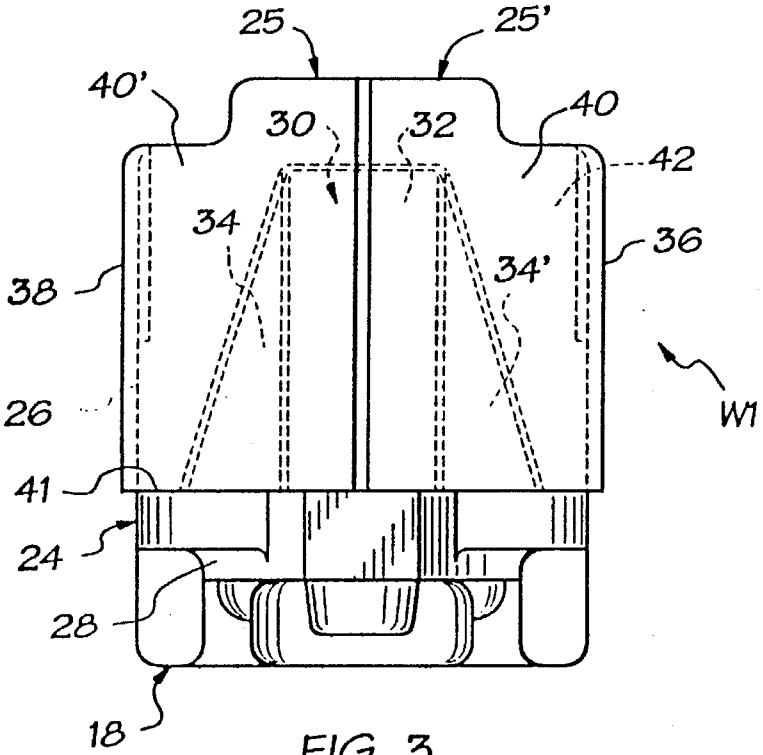
FIG. 3 is a left side elevational view of the friction wedge of FIG. 2.

In a first embodiment of the friction wedge, an angulated wedge-shaped, metal pad-support body 30 provides a planar support surface 32 for twin pad members 25 and 25' (shown in FIG. 3) symmetrically disposed in mirror image relationship with each other about a vertical plane at right angles to the surface 32. Further support for the pad members 25 and 25' is provided by support surfaces 34 and 34' seen as right triangles which extend downwardly from the surface 32 in planes at angles to the x-y plane, each plane at the same angle but oppositely directed, from opposed sides of the support surface 32, and the planes terminate at the upper (or inner) surface 41 of the base 28 (FIG. 4).

Each pad member 25 and 25' is preferably molded, one a mirror image of the other, so as to present inclined planar pad surfaces 40 and 40' respectively, which abut the slanted surface 12 provided by the rear wall 12 of the bolster pocket 11. Side 36 of the pad member 25' confines a mass of polymer having an arched rear surface because the mass is molded arcuately to conform to the surfaces 32 and 34' so as to be snugly fitted thereupon. Similarly, side 38 of the pad member 25 confines a mass of polymer the arched rear surface of which conforms to the surfaces 32 and 34 so as to be snugly fitted thereupon. The upper and lower edges of each pad have planar surfaces which abut the vertical inner surface 42 of the vertical wall 26, and the horizontal inner surface 41 of the horizontal base 28 (FIG. 4). It will now be seen that, when the friction wedge is positioned within the bolster pocket, the surfaces 40 and 40' of the pads will bear against and be in coextensive contact, with the inner surface of rear wall 12 of bolster pocket 11. Further, the support 30 being shaped to receive the pad members with surfaces which complement the inner surfaces of the pad members, facilitates the quick and error-free installation of replacement pads, should the need for replacement of the pads arise.

The wedge-shaped support 30 is designed to tend to force the two pad members apart during use so that they will completely fill the bolster pocket and the sides 36 and 38 of the pad members will bear against the side walls of the bolster pocket. In this manner, the pad members compensate for deviations in the bolster pocket, from the precise dimensions desired, which though within specified tolerances, are expected. Such deviations may be due to casting tolerances, or, irregularities in the surfaces of the bolster pocket, or, misalignment between the side frame column and the bolster. Further, the twin pads ensure that the wedge-shaped support 30 is correctly positioned within the bolster pocket, and that the outer surface 20 of the vertical wall 26, is in firm and complete contact with the guide column side frame 14.

With the above-described structure of the components of the friction wedge, it is evident that the relative movement between the friction wedge and the bolster pocket is minimized. Such movement as does occur between the friction wedge and the bolster pocket does not produce any appreciable wear in the bolster pocket because of the contrast between the hardnesses of the materials; the hardness of cast steel is about 270 BHN (Brinell hardness number) versus about Shore D 75 for the polymer. The effect of such little movement as does occur is further minimized because of the low coefficient of sliding friction of the polymer.

The coefficient of sliding friction in the range from 0.3 to 0.4 stated above, is measured at 25.5° C. between clean steel plates using an external load in the range from 30–40 kips, to simulate the expected range of loads on each pocket formed with two bolsters of a car, which load is distributed evenly between 8 friction wedges in 8 bolster pockets.

Figure 5:
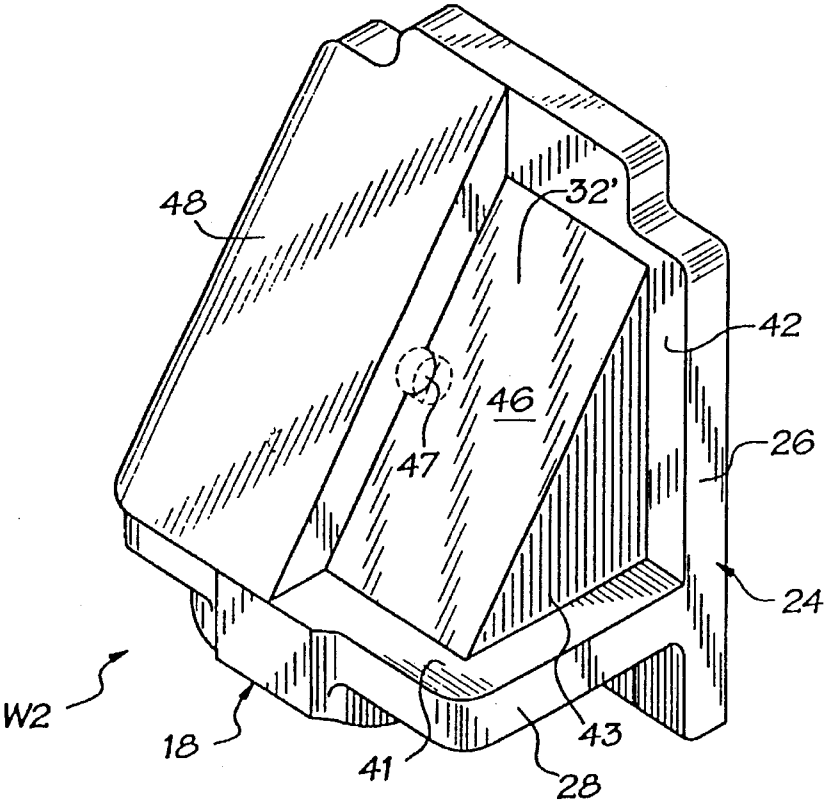
FIG. 5 is an isometric view, of a second embodiment of the friction wedge showing a single pad member, partially in cross section in its central vertical plane, secured by a stem portion snugly fitted in a bore in the slanted face of the metal body's support member.

In a second embodiment, illustrated in FIG. 5 a friction wedge W2 includes a single pad means 48 secured on a wedge-shaped, acicular cast iron pad-support body 46 provided with an inclined, planar, central surface 32'. The pad 48 is a unitairy, rectangular mass of RIM polymer having a planar rear surface which lies coextensively upon the surface 32'. Sides 43 and 43' (the latter not visible) of the pad-support body 46 lie in spaced apart vertical planes, orthogonal to the x- and y-axes so that the pad-support 46 is a right-triangle wedged between vertical wall 26 and horizontal base 28. The pad 48 is removably secured in a bore in the planar central support surface 32' by a stem 47 snugly fitted therein with the top and bottom edges of the pad abutting the inner surfaces 41 and 42 of the vertical wall 26 and the horizontal base 28, respectively. The side edges of the rectangular pad 48, though not visible in the drawing, have a thickness corresponding to that of the pad's cross-section shown, and the width of the pad (along the z-axis) is chosen so as to be slidably snugly fitted in the bolster pocket. With a pad means so secured, it is not essential that the side edges abut the side walls of the bolster pocket, though it is desirable that they do so.

Figure 6:
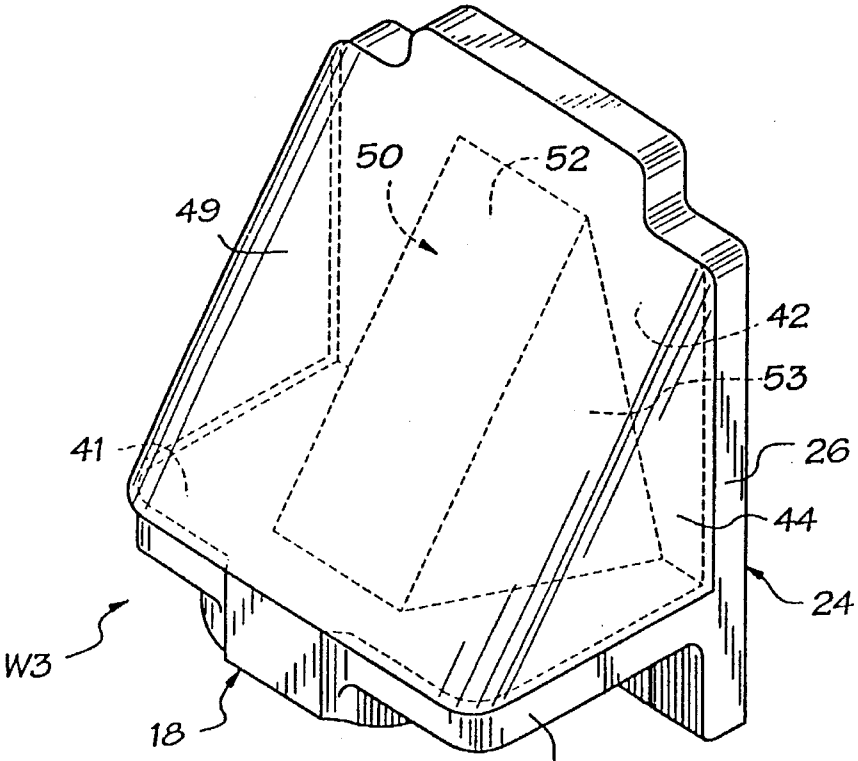
FIG. 6 is an isometric view of the friction wedge showing a third embodiment of the friction wedge with a single pad member covering the support member.

A third embodiment W3 of the friction wedge is illustrated in FIG. 6 to provide a shaped support body 50 having a wrap-around surface of arbitrary configuration designed to conform to the inner surfaces of a single pad member 49 to be used in a pocket in those instances where it is deemed desirable to provide a pad with sides 44 and 44' (only the former is visible) to contact the sides of the pocket. The wrap-around support includes a central, planar, inclined, support surface 52 with downwardly and outwardly flaring inclined side surfaces 53 and 53' (only the former is visible), meeting the inclined surface 52 at its side edges, in a smoothly joined large radius in the range from about 75–125 cm (30"–50"). As in FIGS. 4 and 5, the side surfaces 53 and 53' are angled with respect to the x-y plane, each plane at the same angle but oppositely directed. The large radius of the support 50 is matched by the radius of the arched inner surface of the pad 49, and together accurately locate the center of pressure on the friction wedge under load. Less preferably, the sides of the support may be blended into the inclined support surface with a short radius as shown in FIGS. 4 and 5.

Figure 7:
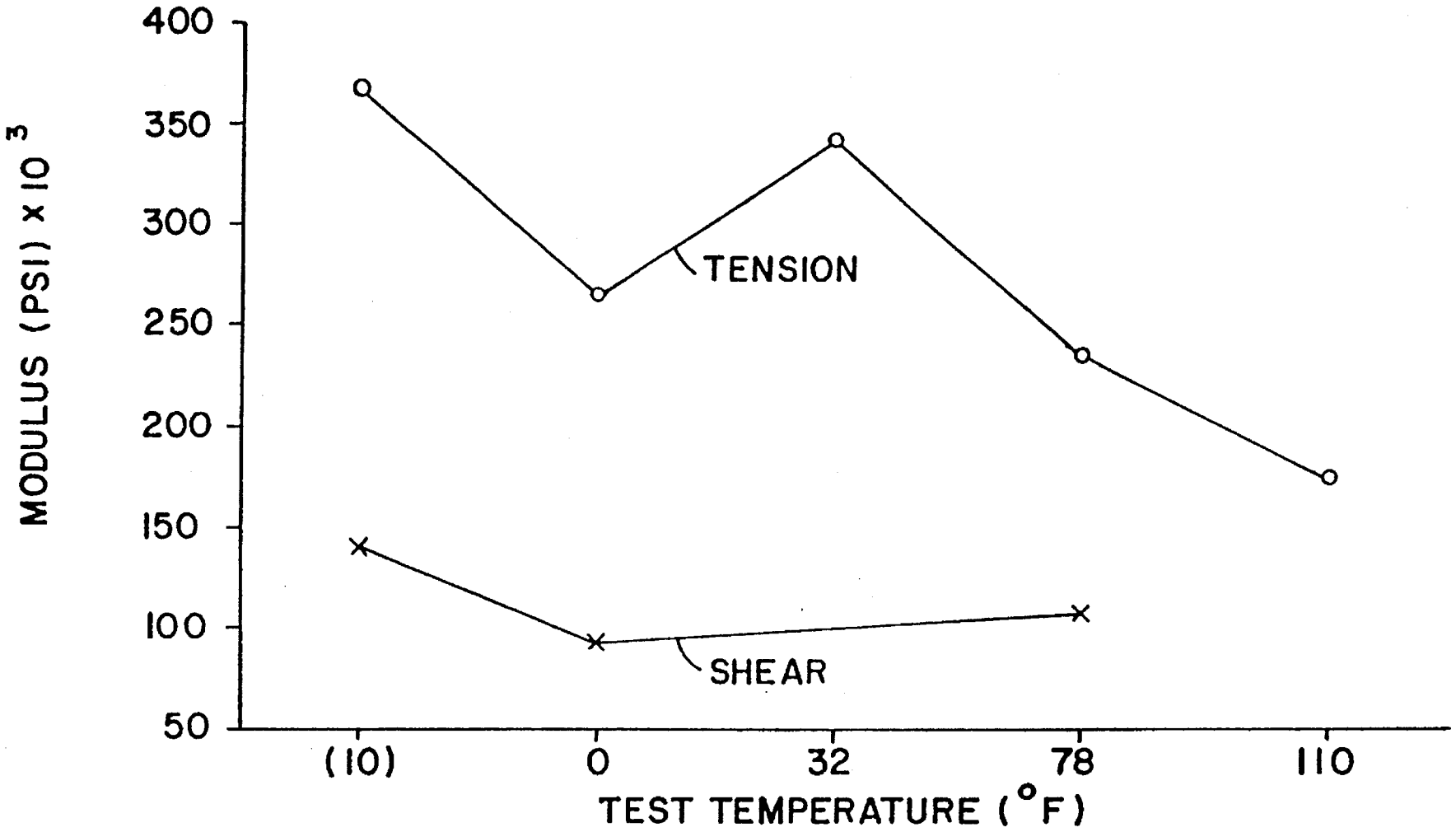
FIG. 7 is a graph in which is plotted the tension and shear moduli respectively, as a function of temperature, for the most preferred PE-containing Nyrim® triblock copolymer.

Referring now to FIG. 7 there is shown a graph for the modulus of elasticity in tension of XP-91 measured at different temperatures corresponding to the ambient temperatures expected to be encountered by a railroad car in normal operation in this country. Even at a temperature as high as 43° C. (110° F.) it is seen that the modulus is greater than 150,000 psi, and does not decrease at lower temperatures.

Figure 8:
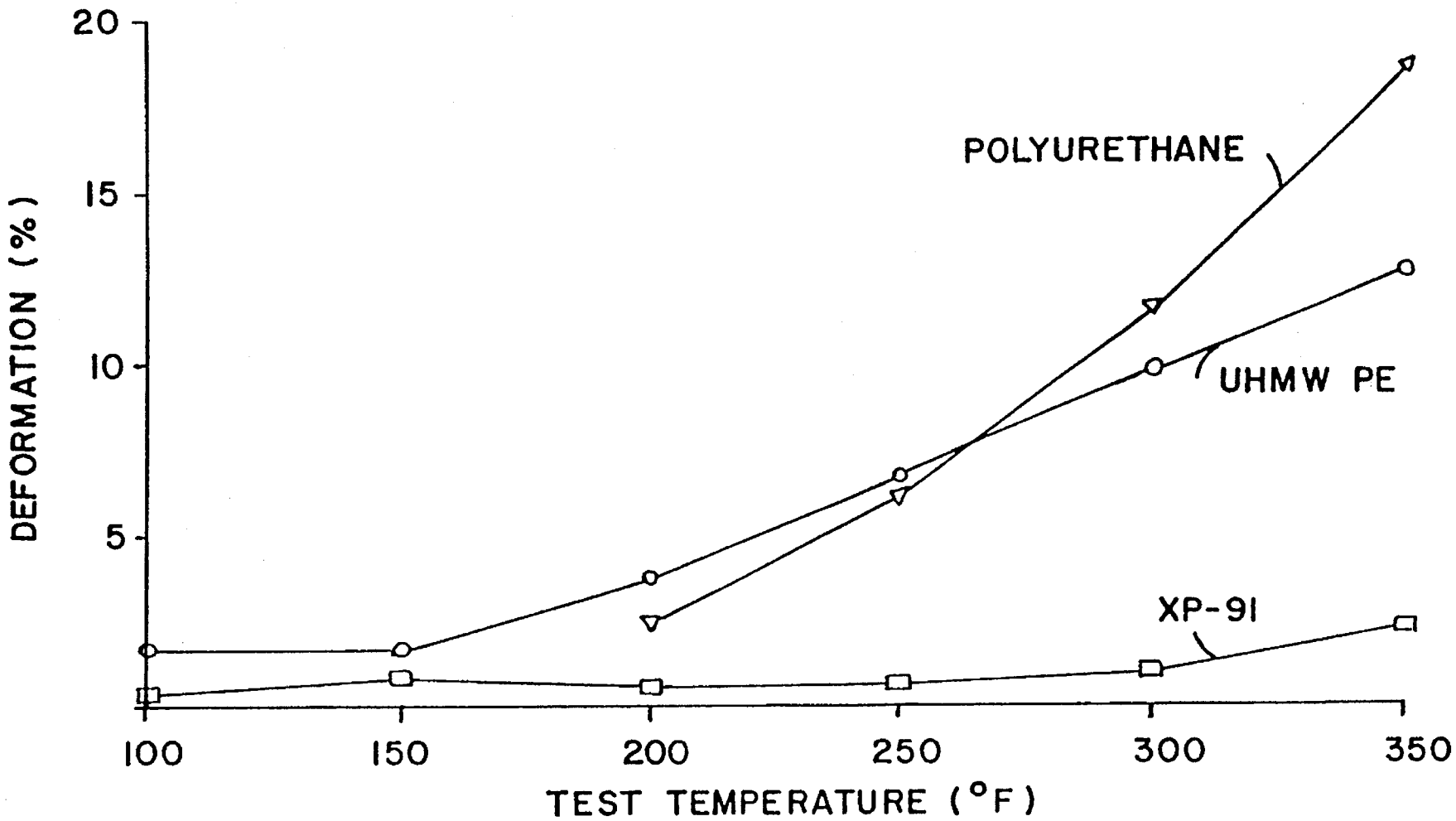
FIG. 8 is a graph in which is plotted the percent deformation as a function of temperature for (i) UHMW PE taught in the '521 patent; (ii) a cast polyurethane containing molybdenum sulfide having a Shore D <70, which is commercially available; and, (iii) a triblock copolymer of a major amount by weight of ε-aminocaproic acid (caprolactam) and a polyol prepolymer commercially available under the Nyrim® brand, having dispersed therein a minor amount of surface-modified polyethylene.

Referring now to FIG. 8 there is shown a graph for the compressive deformation (%) as a function of temperature (° F.), of two prior art materials for pools, namely cast molybdenum-filled polyurethane (UMF), cast UHMW PE and XP-91, used herein, each so identified on the graph. As is evident, even at 350° F., the XP-91 suffers minimal compressive deformation and at 100° F., suffers essentially none. This indicates that the XP-91 is substantially non-deformable, rigid, and incompressible.

Figure 9:
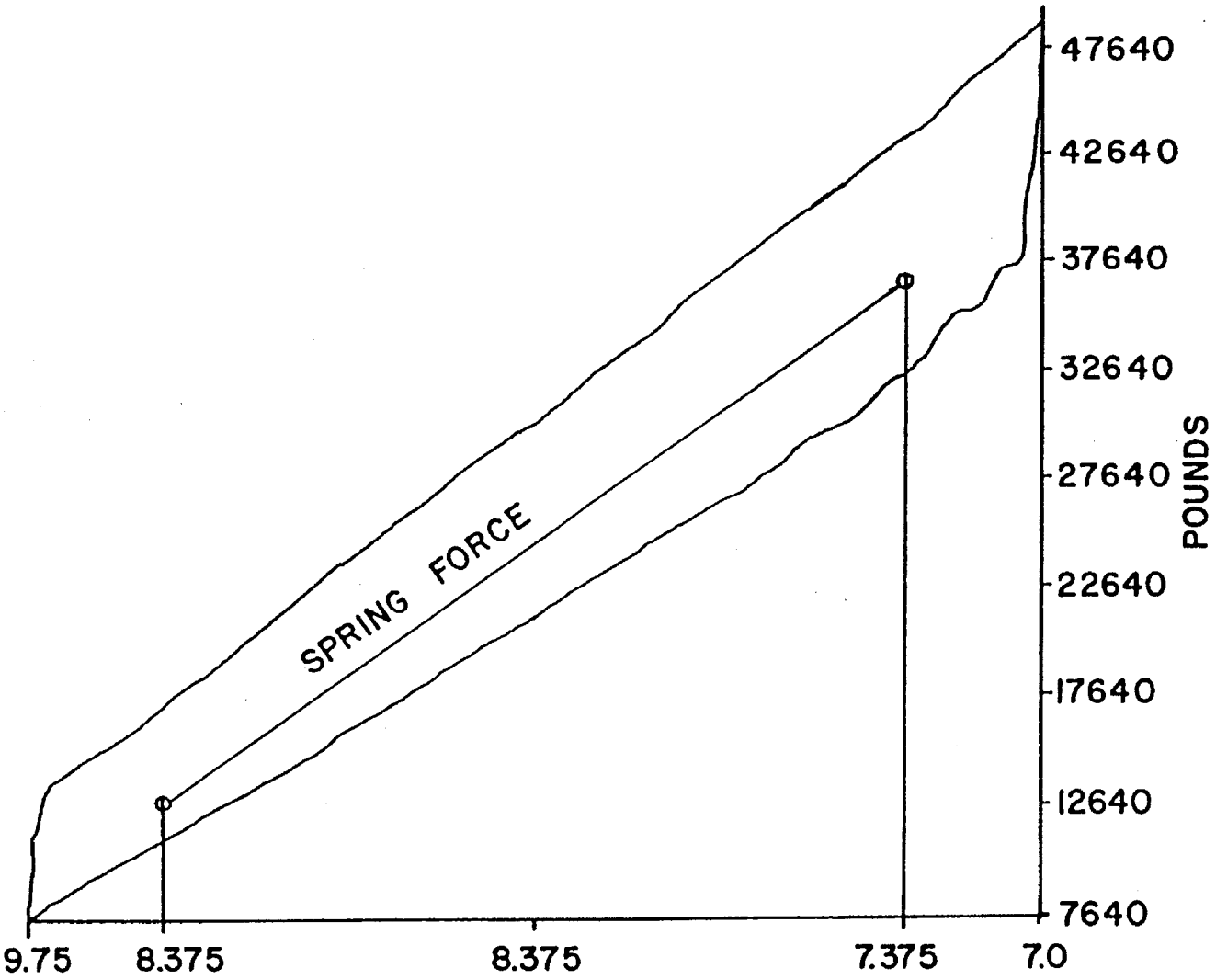
FIG. 9 is a hysterisis curve for a unitary friction casting of acicular cast iron used as the bench-mark against which the energy loss of pad members of different polymers is measured.

Referring to FIG. 9 there is shown a hysterisis loop for acicular cast iron, this being the material of choice for a conventional non-polymer containing friction casting. Under a load which reached 48,800 lb the energy loss is calculated to be 24,000 in.lb.

Figure 10:
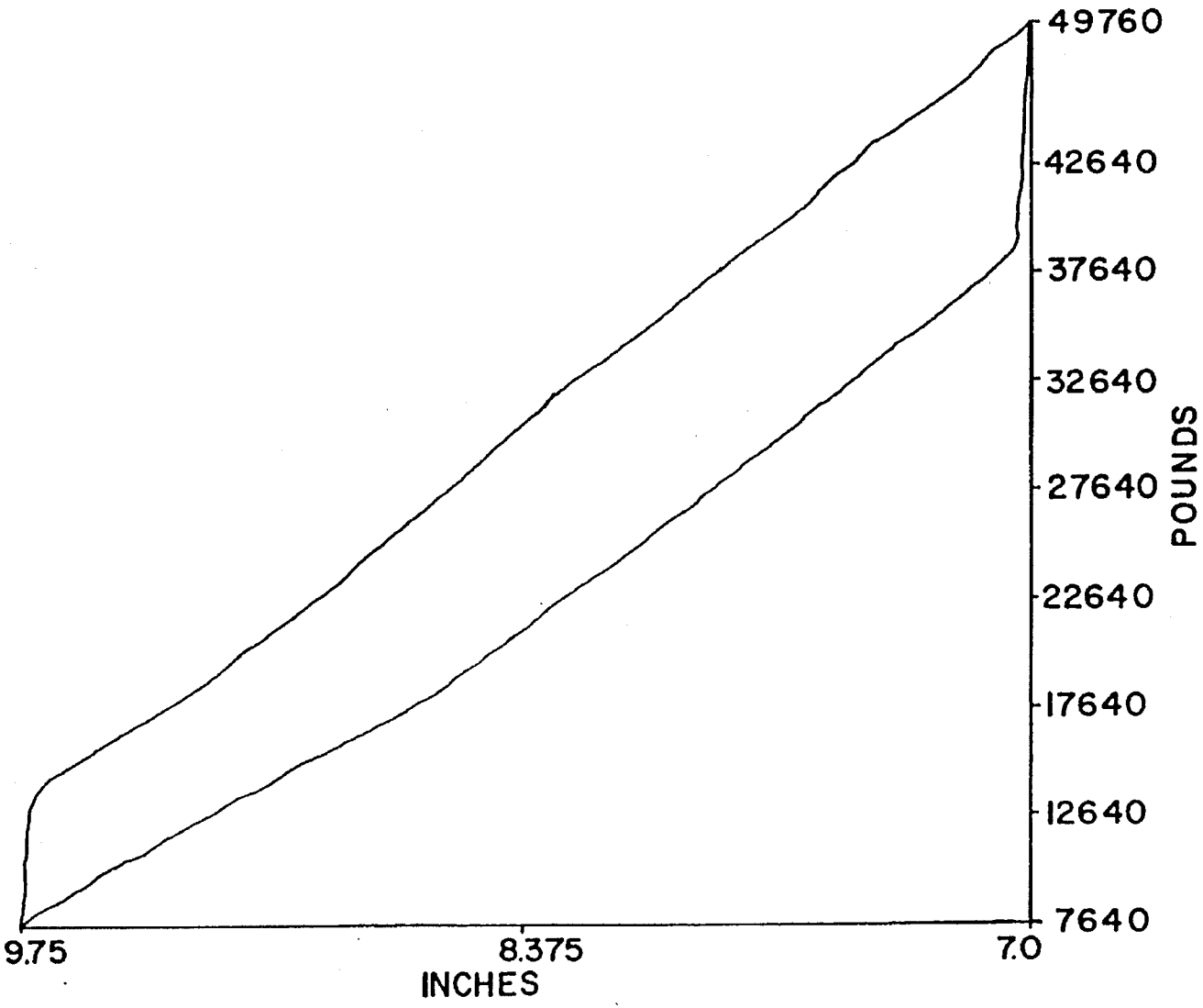
FIG. 10 is a hysterisis curve for a fully dense pad member of RIM polyurethane having molybdenum disulfide dispersed therein.

Referring to FIG. 10 there is shown a hysterisis loop for a RIM polyurethane filled with 5% by weight of molybdenum pentasulfide under a load which reached 49,760 lb. The energy loss is calculated to be 23,400 in.lb., indicating that, relative to the acicular cast iron, it has lost only 2.5%.

Figure 11:
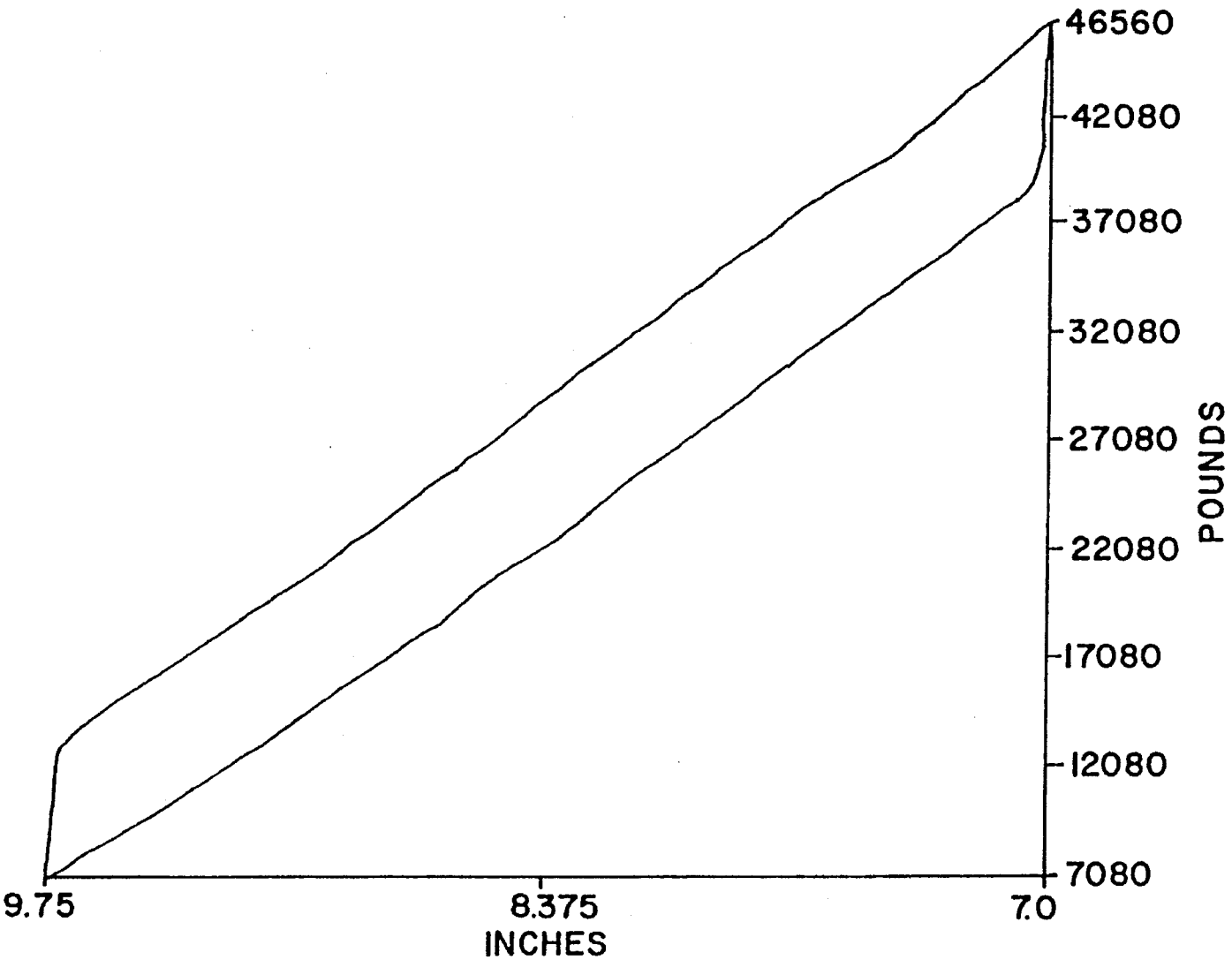
FIG. 11 is a hysterisis curve for a commercially available pad member of polyurethane having a Shore D 60 hardness measured at 25.5° C.

Referring to FIG. 11 there is shown a hysterisis loop for a prior art cast polyurethane having a hardness of 60 Shore D, under a load which reached 46,560 lb. The energy loss is calculated to be 17,925 in.lb., indicating that, relative to the acicular cast iron, it has lost 25.0%.

Figure 12:
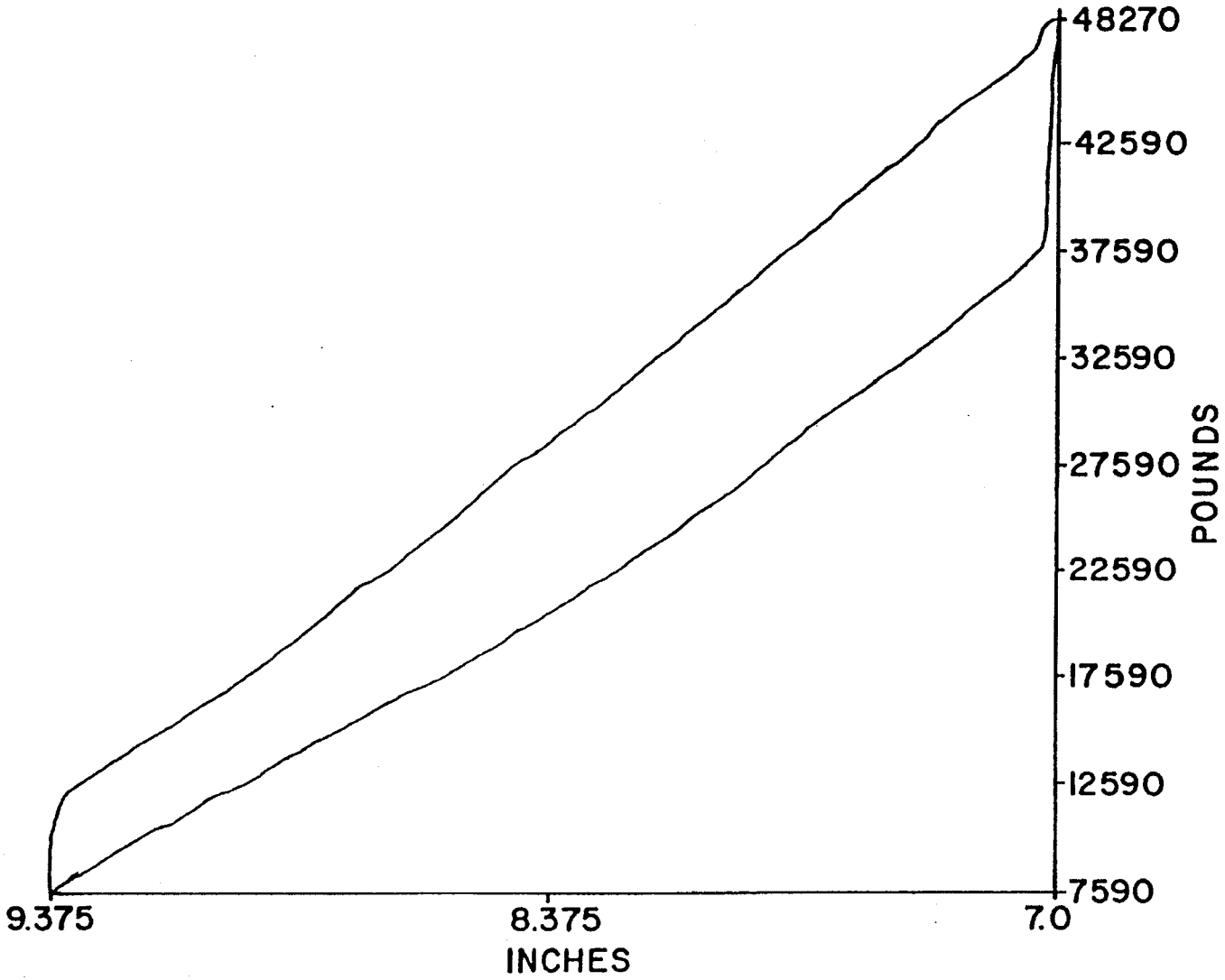
FIG. 12 is a hysterisis curve for the novel pad member of a Nyrim® copolymer having a Shore D 75 hardness measured at 25.5° C.

Referring to FIG. 12 there is shown a hysterisis loop for a RIM Nyrim® triblock copolymer filled with 5% by weight of surface modified PE under a load which reached about 48,000 lb. The energy loss is calculated to be 20,550 in.lb., indicating that, relative to the acicular cast iron, it has lost only 14%.

From the foregoing hysterisis curves it is evident that only a fully dense material provides less than 25% energy loss relative to acicular cast iron.

Having thus provided a general discussion, described the overall friction wedge in detail and illustrated the invention with specific examples of the best mode of carrying it out, it will be evident that the invention has provided an effective solution to a difficult problem. It is therefore to be understood that no undue restrictions are to be imposed by reason of the specific embodiments illustrated and discussed, and particularly that the invention is not restricted to a slavish adherence to the details set forth herein.

We claim:

1. A friction wedge for use in a bolster of a railroad car truck having a bolster pocket, said bolster pocket having an inclined surface on a wall provided by the exterior surface of a terminal portion of said bolster, and spaced-apart vertical side walls generally perpendicular to said inclined surface and a horizontal plane, said friction wedge comprising, a wedge-shaped metal body having a vertical wall with an outer surface thereof adapted to bear against a portion of a guide member of a side frame of said truck, a horizontal base member, and, a support body joining said vertical wall and said horizontal base member at their inner surfaces, said support body having a support surface inclined to said inner surfaces, said support surface having a configuration adapted to coextensively, abuttingly complement a central portion of an inner surface of a pad means comprising a substantially rigid and essentially non-deformable reaction injection molded polymer matrix infused with a minor proportion of polyethylene, said polymer matrix having a hardness in the range from 70–90 Shore D, said pad means being stable to thermal and oxidative degradation, fully dense, and having essentially no compressive deformation under pressure of 6900 kPa (1000 psi) and a temperature of 38.8° C. (100° F.); and, said pad means having an inclined pad surface adapted to conform to said inclined surface of said bolster pocket;

whereby said wedge-shaped metal body causes said pad means to be adapted to bear against said inclined surface of said bolster pocket during operation of said railroad car truck.

2. The friction wedge of claim 1 wherein said polymer matrix has a durometer hardness in the range from 75–80 Shore D; a modulus of elasticity in tension (tension modulus) of at least 1.03 MPa (150,000 psi); and, a modulus of elasticity in shear (shear modulus) of at least 689,000 kPa (100,000 psi); both measured at room temperature 25.5° C. (78° F.).

3. The friction wedge of claim 2 wherein said polymer matrix has a tensile strength of at least 27500 kPa (4000 psi), measured at 25° C., with specimens having a nominal thickness of 0.635 cm (0.250"), measuring from 0.15% in/in strain to 0.20% in/in strain; and, said polymer matrix has a reduction in energy loss relative to acicular iron, of less than 25%.

4. The friction wedge of claim 3 wherein said polymer matrix is selected from the group consisting of a (i) triblock copolymer of a polyol prepolymer and a ring-openable lactam; (ii) substantially crosslinked polyurethane; (ii) substantially crosslinked polyurea; (iv) substantially crosslinked polymer of one (homopolymer) or more (copolymer) cyclodiolefins; and (iv) nylon.

5. The friction wedge of claim 4 wherein said compressive deformation of said pad member under conditions set forth, is less than 1%.

6. The friction wedge of claim 5 wherein said compressive deformation, or strain, of said pad member under pressure of 6900 kPa (1000 psi) and a temperature of 177° C. (350° F.) is less than 5%.

7. The friction wedge of claim 1 wherein said polymer matrix includes dispersed therein from 1 to 20% by weight of a surface modified polyolefin present in said polymer matrix as a disperse phase, said polymer matrix being present as a continuous phase.

8. The friction wedge of claim 7 wherein said compressive deformation of said pad member, measured at 25° C., with specimens 0.635 cm (0.25") thick, is less than 1%.

9. The friction wedge of claim 7 wherein said compressive deformation of said pad member under pressure of 6900 kPa (1000 psi) and a temperature of 177° C. (350° F.) is less than 5%.

10. The friction wedge of claim 4 wherein said metal body is acicular cast iron, said pad means has a coefficient of sliding friction in the range from 0.1 but not more than 0.2, measured at 25.5° C. between clean steel plates using an external load in the range from 4–20 kips, and, said pad means is removably secured to said support body.

11. The friction wedge of claim 10 wherein said polymer matrix is selected from the group consisting of (i) triblock copolymer of a polyol prepolymer and a ring-openable lactam; and (ii) substantially crosslinked polyurethane.

12. The friction wedge of claim 11 wherein said polymer matrix has dispersed therein from 1 to 20% by weight of a surface modified polyethylene present in said polymer matrix as a disperse phase, said polymer matrix being present as a continuous phase.

13. In a friction wedge for use in a railroad car truck, wherein a bolster having a pocket with an inclined surface and spaced-apart vertical side walls generally perpendicular to said inclined surface on either side thereof and a horizontal plane, is fitted with said friction wedge comprising a wedge-shaped metal body having a vertical wall with an outer surface thereof bearing against a portion of a guide column of a side frame of said truck, a horizontal base member, and, a support body joining said vertical wall and said horizontal base member at their inner surfaces, said support body having a support surface inclined to said inner surfaces, the improvement comprising, a pad means supported on said support surface having a configuration adapted to coextensively, abuttingly complement a central portion of an inner surface of said pad means;

said pad means comprising, a substantially rigid and essentially non-deformable reaction injection molded polymer matrix infused with a minor proportion of polyethylene, said polymer matrix having a hardness in the range from 70–90 Shore D, said pad means being stable to thermal and oxidative degradation, fully dense, and having essentially no compressive deformation under pressure of 6900 kPa (1000 psi) and a temperature of 38.8° C. (100° F.); and, an inclined surface of said means pad, adapted to conform to said inclined surface of said bolster pocket;

whereby said wedge-shaped metal body causes said pad means to bear against said bolster pocket's inclined surface during operation of said railroad car.

14. The friction wedge of claim 13 wherein said polymer matrix is selected from the group consisting of a (i) triblock copolymer of a polyol prepolymer and a ring-openable lactam; (ii) substantially crosslinked polyurethane; (ii) substantially crosslinked polyurea; (iv) substantially crosslinked polymer of one (homopolymer) or more (copolymer) cyclodiolefins; and (iv) nylon.

15. The friction wedge of claim 14 wherein said polymer matrix has dispersed therein from 1 to 20% by weight of a surface modified polyethylene present in said polymer matrix as a disperse phase, said polymer matrix being present as a continuous phase.

16. The friction wedge of claim 15 wherein said compressive deformation, or strain, of said pad member under conditions set forth, is less than 1%.

17. The friction wedge of claim 16 wherein said compressive deformation of said pad member 0.635 cm (0.25") thick under pressure of 6900 kPa (1000 psi) and a temperature of 177° C. (350° F.) is less than 5%.

18. In a friction wedge for use in a railroad car truck, said friction wedge comprising in combination, a friction casting and a polymer pad means, the improvement comprising, said pad means consisting essentially of a substantially rigid and essentially non-deformable reaction injection molded polymer matrix infused with a minor proportion of polyethylene, said polymer matrix having a hardness in the range from 70–90 Shore D, said pad means being stable to thermal and oxidative degradation, fully dense, and having essentially no compressive deformation under pressure of 6900 kPa (1000 psi) and a temperature of 38.8° C. (100° F.).

19. The friction wedge of claim 18 wherein said polymer matrix is selected from the group consisting of a (i) triblock copolymer of a polyol prepolymer and a ring-openable lactam; (ii) substantially crosslinked polyurethane; (ii) substantially crosslinked polyurea; (iv) substantially crosslinked polymer of one (homopolymer) or more (copolymer) cyclodiolefins; and (iv) nylon.

20. The friction wedge of claim 19 wherein, said polymer matrix has dispersed therein from 1 to 20% by weight of a surface modified polyethylene present in said polymer matrix as a disperse phase, said polymer matrix being present as a continuous phase;

said polymer matrix has a compressive deformation of less than 1%, and a compressive deformation of less than 5% under pressure of 6900 kPa (1000 psi) and a temperature of 177° C. (350° F.); and, said polymer matrix has a modulus of elasticity in tension of at least 1.03 MPa (150,000 psi); and, a modulus of elasticity in shear of at least 689,000 kPa (100,000 psi); both measured at room temperature 25.5° C. (78° F.).

* * * * *